United States Patent [19]

Keller

[11] Patent Number: 4,604,875

[45] Date of Patent: Aug. 12, 1986

[54] ICE MACHINE

[75] Inventor: Paul Keller, Coon Rapids, Minn.

[73] Assignee: Kellex Industries Ltd., Minneapolis, Minn.

[21] Appl. No.: 677,284

[22] Filed: Dec. 3, 1984

[51] Int. Cl.[4] ..... F25C 1/14

[52] U.S. Cl. ..... 62/354; 62/344; 239/567; 239/568; 239/DIG. 1

[58] Field of Search ..... 62/344, 347, 354; 239/567, 568, DIG. 1; 222/410

[56] References Cited

U.S. PATENT DOCUMENTS

| | | | |
|---|---|---|---|
| 2,547,868 | 4/1951 | Judson | 222/410 X |
| 3,059,458 | 10/1962 | Mueller et al. | 222/410 X |
| 3,192,734 | 7/1965 | Swanson | 222/410 X |
| 3,228,202 | 1/1966 | Cornelius | 62/71 |
| 3,342,040 | 9/1967 | Dedricks et al. | 62/344 X |
| 3,592,368 | 7/1971 | Huette | 222/410 |
| 3,716,192 | 2/1973 | Hunter | 239/568 X |
| 3,740,963 | 6/1973 | Lyman et al. | 62/354 X |
| 4,123,918 | 11/1978 | Kohl et al. | 222/410 X |
| 4,470,522 | 9/1984 | Lents et al. | 222/410 X |
| 4,532,776 | 8/1985 | Arcangeli | 62/354 |

*Primary Examiner*—William E. Tapolcai
*Attorney, Agent, or Firm*—James V. Harmon

[57] ABSTRACT

An apparatus is described for forming cracked ice by producing a layer of ice on the inner wall of a cylindrical chamber, heating the chamber to loosen the ice, forcing the ice cylinder upwardly past a breaker which is stationary and allowing the ice to accummulate in a hopper. A ring-shaped conveyor provided with circumferentially-spaced paddles is driven by means of a motor mounted on one side of the hopper to carry pieces of cracked ice toward an outlet in the hopper.

6 Claims, 13 Drawing Figures

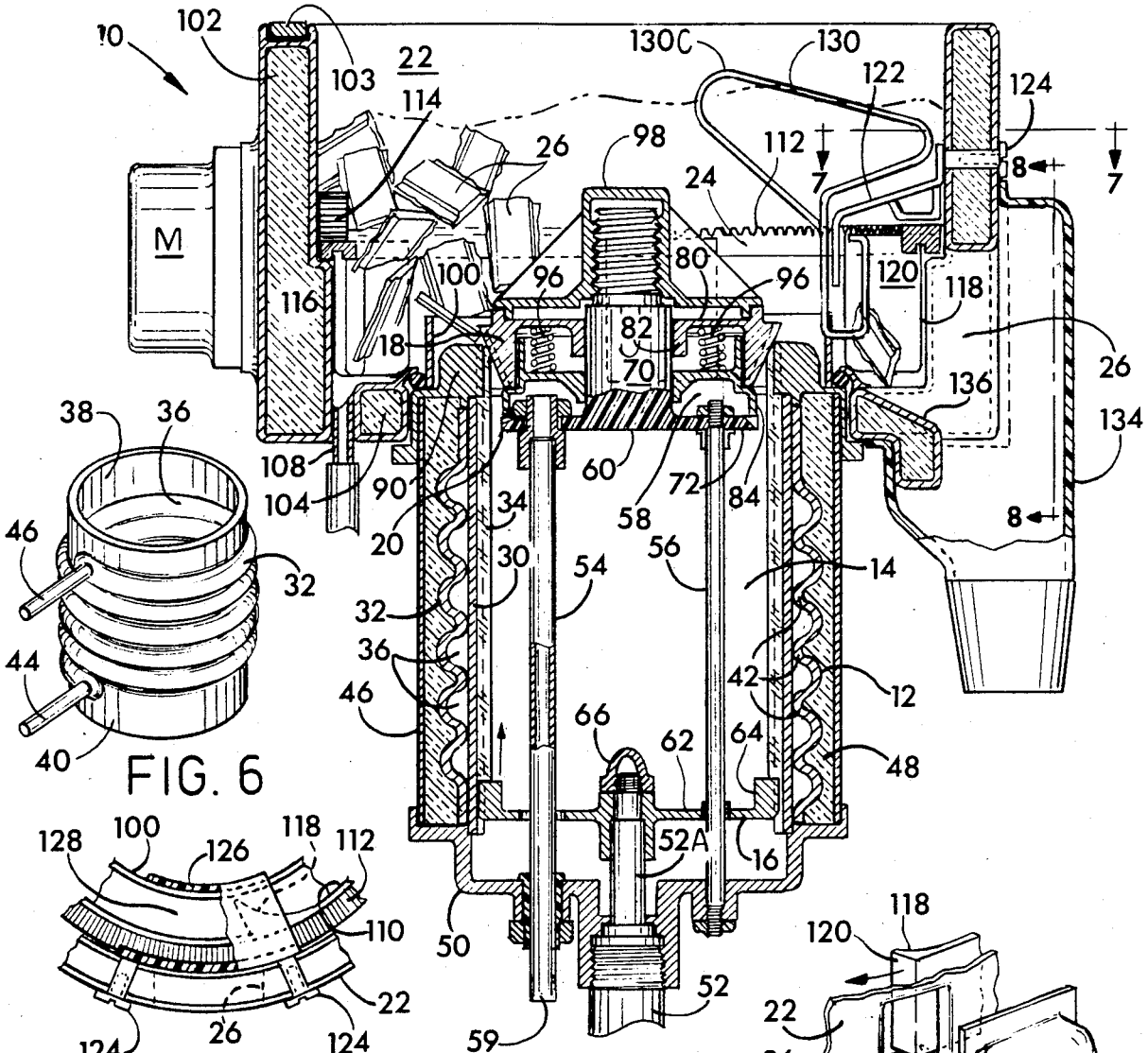
FIG. 2
FIG. 6
FIG. 7
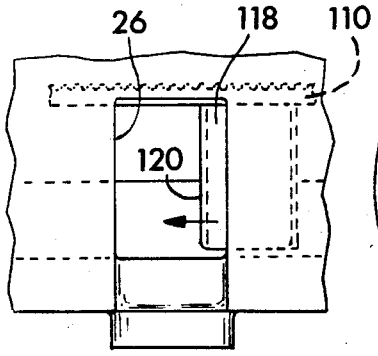
FIG. 3
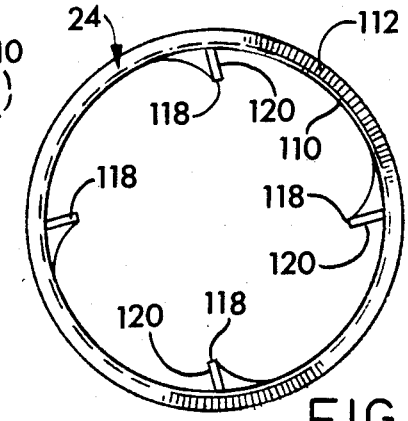
FIG. 10
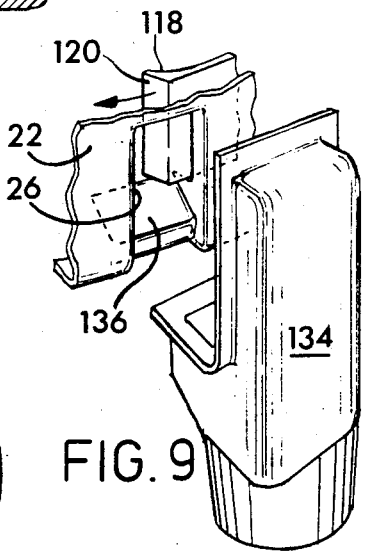
FIG. 9

ICE MACHINE

FIELD OF THE INVENTION

The present invention relates to improvements in ice making equipment and more particularly to an apparatus for making a solid body of ice and for subdividing the solid body of ice into smaller pieces of a desired size.

BACKGROUND OF THE INVENTION

Ice making equipment of the general type described is exemplified by U.S. Pat. No. 3,288,202. This equipment however has certain shortcomings. First, heat transmission between the freezing chamber and the refrigeration coil is not optimized. As a result the amount of ice produced per hour is not as great as it could be. Second, the ice layer built up on the inside of the ice forming chamber is not always uniform in thickness. Consequently, the ice pieces which are formed from it are not uniform in size and as a result the qualities of the finished product cannot be controlled as closely as desired. Third, in prior equipment of the type in which ice is stored in a hopper above the ice forming chamber, the ice is not always reliably dispensed from the hopper in uniform quantities. In prior equipment the ice is typically dispensed by means of an agitator that includes one or more arms which project radially from a central drive shaft aligned with the vertical axis of the hopper. Ice pieces in the hopper will sometimes stick together or freeze to the wall of the hopper. Such a condition can overload the motor and in some cases damage parts or even stall the motor causing the equipment to malfunction, entirely preventing ice from being dispensed. Another problem is the lack of uniformity in the volume of ice dispensed. In some prior equipment this may be in part due to the fact that the volume of ice near the dispenser outlet changes from time to time so that when the agitator is operated, there is no reliable way to tell how much ice will actually be dispensed from the hopper.

In view of these and other deficiencies of the prior art it is a general objective of the invention to provide an improved apparatus for efficiently producing clear transparent cracked ice at a relatively high capacity in terms of pounds per hour compared with prior equipment of substantially the same overall size. It is another objective to reduce the tendency for the ice dispensing agitator or conveyor from becoming overloaded or stalled and to assure that uniform quantities of ice will be dispensed during each cycle of its operation. It is another object to help assure that the ice sheet formed within the refrigeration chamber is uniform in size, distribution and thickness thereby making sure that the ice delivered to the storage hopper will be uniform with less tendancy to pack or become frozen in place and thereby assuring efficient operation of the dispensing conveyor. Yet another object is to maximize heat transfer between the refrigeration coil and the refrigeration chamber to assist the ice forming means in producing an ice layer of uniform thickness while at the same time enabling the refrigeration chamber to be made of two tubular wall members each formed from a simple sheet metal tube of uniform wall thickness.

These and other more detailed and specific objects of the invention will be apparent in view of the accompanying specification and drawings which illustrate the invention by way of example.

THE DRAWINGS

FIG. 2 is a vertical sectional view of the apparatus taken on line 2—2 of FIG. 1.

FIG. 6 is a perspective view of the exterior of the freezing chamber on a reduced scale.

FIG. 7 is a partial horizontal view taken on Line 7—7 of FIG. 2.

FIG. 8 is a partial vertical sectional view taken on Line 8—8 of FIG. 2.

FIG. 9 is a partial perspective view of the hopper outlet and ice outlet duct as seen from the side of the hopper.

FIG. 10 is a top view of the ice conveyor on a reduced scale.

DETAILED DESCRIPTION

Figure 1:
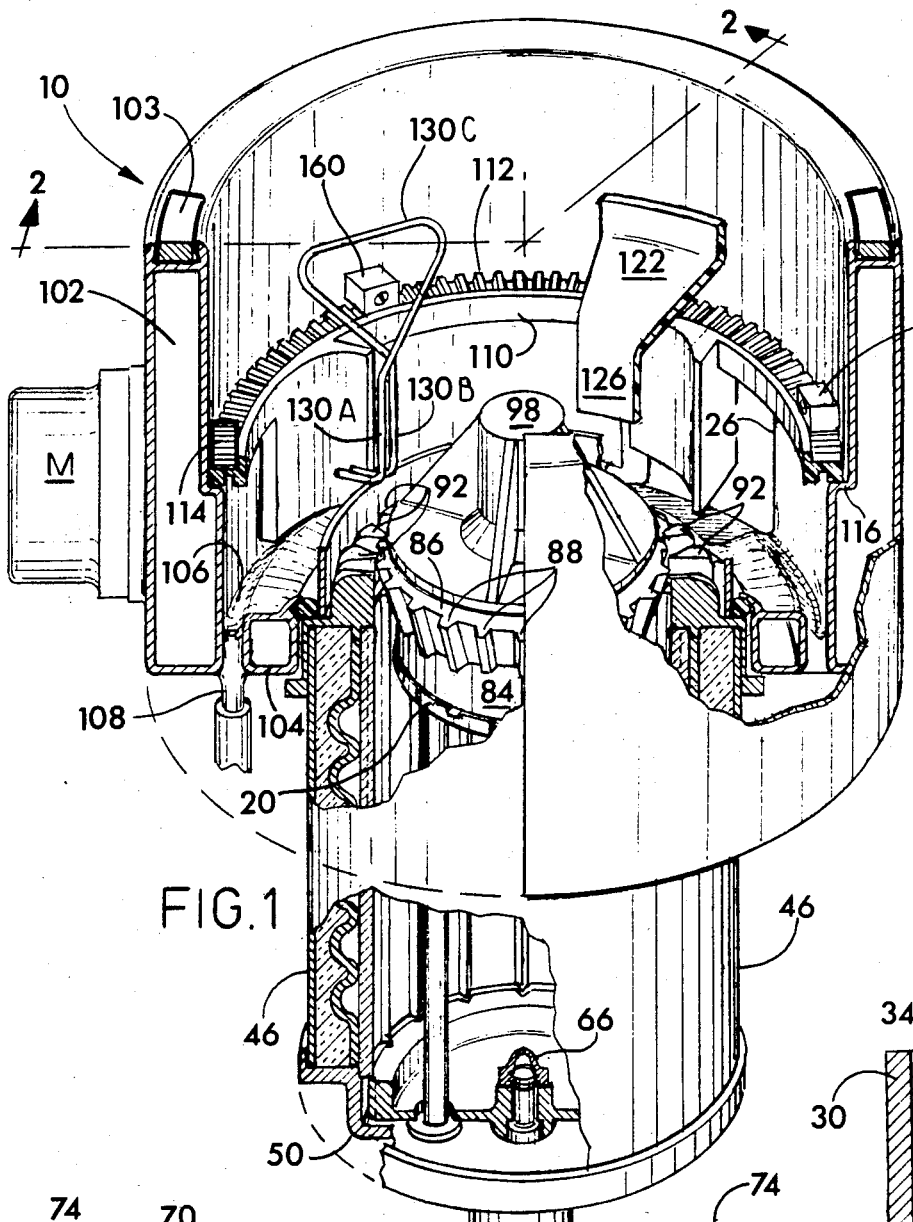
FIG. 1 is a perspective view of the invention partly broken away with the top removed.

Shown in the figures is an ice forming machine 10 which is of the general type illustrated in U.S. Pat. No. 3,228,202 which is incorporated herein by reference.

The major components of the apparatus are refrigeration unit 12, ice forming chamber 14, ice stripping means 16, ice breaker 18, water dispersing unit 20, ice storage hopper 22, cracked ice conveyor 24, and hopper outlet port 26. A summary of the general principles employed in this type of ice making machine will be provided for the purpose of enabling the remaining part of the specification to be more readily understood. The cycle of operation begins by spraying streams of water from the water dispersing unit 20 radially unto a tubular wall of ice forming chamber 14 where during the process of running to the bottom of the chamber a layer of ice is formed. After a period of time e.g. 8 minutes required for the ice to reach the appropriate thickness, the ice stripping means is raised causing the tube of ice 78 thus formed on the inner cylindrical wall of the ice forming chamber to be forced upwardly where it strikes breaker 18 and is broken into pieces 26 which accumulate in the hopper 22. The dispensing conveyor 24 is then operated as required periodically to dispense the desired volume of ice through outlet 26. While the hopper 22 has been shown open at the top it can be provided with a removable cover (not shown) that will function for terminating the freezing cycle when the hopper is full as described in my co-pending patent application Ser. No. 606,582 filed 4/27/84, entitled "Automatic Ice Hopper". The apparatus is also of the general type shown in my copending application Ser. No. 509,322 filed June 30, 1983 entitled "Ice Maker for Producing Variably-Sized Sheet Ice". The provision for changing the size of the broken pieces is however optional.

The refrigeration unit 12 will be described first with particular reference to FIGS. 2 and 6. The refrigeration unit 12 comprises a pair of concentric thin wall tubes 30 and 32 the former being provided with a plurality of circumferentially spaced apart longitudinally extending ribs 34. The outer tube or jacket 32 comprises a tubular sheet metal cylinder of uniform wall thickness the central portion of which is pressed into spiral form thereby producing a helical chamber 36 between itself and the outer surfaces of the tube 30 which defines the ice forming chamber 14. It will be noticed that the undeflected upper and lower sleeve portions 38 and 40 at each end of the jacket 32 are just the proper size to slide over the inner tube 30 to which they are bonded by being welded or sweat soldered to its outside surface. It can also be seen that between the coils of the helix 36, the jacket 32 is provided with uniform inwardly facing convex surfaces arcs which are tangent to and in contact with the outer wall of the tube 30 at uniformly spaced apart intervals 42. It is in part the line contact between these arcs and the helical line of tangency on the surface of the tube that improves the efficiency of heat transfer between the refrigeration gas passing through the helix and the ice forming chamber. Moreover, it will be understood that because the flow of refrigerant between inlet and outlet ducts 44 and 46 is helical, the refrigerant will be distributed uniformly around the entire wall of the ice forming chamber thereby enhancing the uniformity of ice buildup throughout the chamber. Additionally, it will be noted that the refrigerant within the helix 36 contacts the wall of the ice forming chamber 30 directly without any intermediate wall layer and is exposed to the entire central portion of the exterior surface of the refrigeration tube 30. In this way this entire surface is used for the purpose of heat transfer thereby maximizing ice production rates. Between the gas expansion jacket 32 and an exterior cylindrical wall 46 is a layer of thermal insulation to minimize heat transfer from the outside.

The refrigeration unit has a bottom wall 50 to the center of which is secured a stripper actuator 52. Arranged symmetrically around the actuator 52 are three circumferentially spaced apart vertically extending elongated support members (two of which 54 and 56 can be seen) each being threaded at its ends and retained in place by means of nuts near the center of the refrigeration unit to support the ice breaker or spreader 18 within an opening at the top of chamber 14. Beneath the breaker 18 is a water reservoir 58 which is bounded below by means of a base member 60 suitably bored to received the upper ends of support members 54 and 56 and held rigidly in place by means of nuts threaded on the top ends of the supports. It will be noticed that the support 54 is hollow and it is through this support that the water is introduced to the reservoir from water inlet 59. The introduction of water and the simultaneous operation of the refrigeration unit and the cycling of the ice stripper 16 by the actuator 52 and the intermittent operation of the dispensing conveyor 24 is all as described in my previously mentioned patent application Ser. No. 509,322.

The ice stripper or ice harvesting means 16 which is best shown in FIGS. 1 and 2 comprises a disk shaped plate 62 having a circular peripheral upwardly extending collar 64 provided with circumferentially spaced apart vertically extending grooves adapted to receive the ribs 34 and spaced slightly inwardly from the wall of the freezing chamber 14. The stripper 16 is held securely on the upper free end of the actuator rod 52A of the actuator 52 by means of a nut 66.

During operation after an ice layer has formed on the inside surface of the wall 30 and the layer of ice thus formed has been released from the wall by reversing the refrigeration unit to pass hot vapor through the helix 36 as described in any of the aforementioned patents, the upward movement of the actuator rod 52A of the actuator 52 will cause the stripper 16 to rise thereby forcing the ice cylinder against the breaker 18 filling the hopper 22 with broken pieces of ice.

Figure 5A:
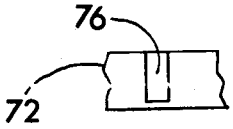
FIG. 5A is a side view taken on Line 5A—5A of FIG. 5.
Figure 5:
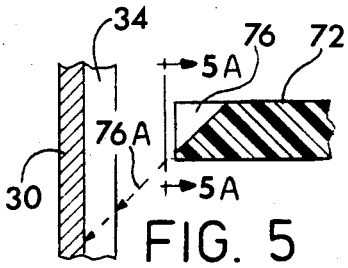
FIG. 5 is a partial vertical sectional view taken on Line 5—5 of FIG. 3.

The breaker 18 and reservoir 58 will now be described in more detail. The base 60 includes a central cylindrical body portion 70 and a circular flange 72 that defines the bottom of the reservoir and acts as a spray ring. It can be seen that spray ring 72 is provided with a plurality of circumferentially spaced apart radially extending upwardly opening slots defining water outlet passages designated 74 alternating around the periphery of ring 72. Those designated 76 are inclined at a steeper angle to form a water jets 76A (FIG. 5) striking the wall 30 a relatively low elevation (substantially below the reservoir) while the slots 74 are oriented at a more gradual incline and direct streams of water 74A that strike the wall 30 at higher elevations. In this way the water streams strike the wall 30 at two different spaced apart elevations around the circumference of the ice forming chamber 14 and it has been discovered that as a result, the ice layer 78 that forms is surprisingly uniform in thickness. The slots 74 are wider than those designated 76 to help even out the flow of water through all of the slots.

The top of the reservoir 58 is defined by a reservoir cover 80 having a central opening 82 which forms a sliding fit over the cylindrical body 70 of the base 60. The reservoir cover includes a downwardly extending peripheral collar 84 which forms the side wall of reservoir 58 and includes a circular lower edge which is sealed against the upper surface of the periphery of spray ring 72. Supported upon the cylindrical body 70 above the reservoir cover is a spreader or breaker 86 having a plurality of circumferentially spaced peripheral teeth 88 which break up the rising column of ice when the ice stripper 16 is elevated. To assist in breaking the ice sheet 78 there is provided a cap ring 90 having a plurality of teeth 92 spaced exterially of the teeth 88 and interdigitated between them. The cap ring 90 is rigidly secured to the top of the ice forming chamber 14 with the inner edges of the teeth 92 in vertrical alignment above the ribs 34. To allow the vertical spacing between the breaker 18 and the cap ring 90 to be selectively adjusted, several compression springs 96 are mounted between the breaker 18 and the top of the reservoir 82. The breaker is held in place by means of a retaining cover 98 which is screw threaded onto the top portion of the base 60 so that the breaker can be raised or lowered as required to form longer or shorter pieces of broken ice as desired. The cap ring 90 also includes an unwardly extending circular collar 100 defining the inner edge of a conveyor channel which will be described in more detail below.

The hopper will now be described in more detail. As can be seen the hopper 22 is generally cup shaped and includes a thermally insulated side wall 102 and bottom wall 104 having a circular water collection gutter 106 that is inclined downwardly at a slight angle away from the ice outlet 26 to a low point diametrically opposite from it. At the low point is provided water outlet duct 108 to carry away water that may accumulate from time to time in the hopper. The distance between the cover (not shown) and the hopper can be sensed by means of one or more magnetic switches 103 as described in my previously mentioned application.

The conveyor 24 for dispensing ice will now be described. The conveyor 24 comprises a ring shaped body 110 having gear teeth 112 on its upper surface to define a ring gear engaged with a pinion gear 114 and drive motor M. In this way the operation of drive motor and rotation of the pinion gear 114 will rotate the ring shaped conveyor 24 on the vertical central axis of the hopper 22. The ring 110 is supported upon a circular shoulder 116 in the interior of the hopper. Depending from the ring 110 are a plurality of conveyor paddles 118 each having a flat vertically disposed front face 120 which during operation move the ice in a circle around the periphery of the hopper 22 through a channel toward the outlet 26 which comprises an opening in the side wall 102 extending from the bottom wall about halfway to the top of the hopper. Positioned adjacent to the outlet 26 and spaced inwardly from the sidewall 102 of the hopper 22 is the shield 122 suitably secured at its upper end by means of screws 124 to the wall of the hopper 102. The shield 122 includes an inclined top wall and a vertically disposed inner wall 126 positioned adjacent to the tubular wall 100 of end cap 90. In this way a passage or channel 128 (FIG. 7) is formed in the hopper adjacent to outlet 26 and it is through this channel 128 that the paddles 118 move in succession to dispense the ice from the hopper. Since the height, width and length of the channel 128 are precisely determined and because the distance traveled by the paddle 118 closest to the channel is controlled (a distance e.g. of two inches per cycle) the quantity of ice dispensed during each cycle of operation will be very consistent. For example, in some applications two ounces of ice should be dispensed per cycle. In other applications it may be desirable to dispense three ounces of ice per cycle and with the present invention the amount dispensed can be accurately controlled by changing the distance the paddles travel during each cycle.

If desired, an optional ice agitator 130 can be connected to one of the paddles 118 or to some other part of the conveyor 24. The agitator is formed from a wire loop including a pair of legs 130*a* and 130*b* and an upwardly and centrally projecting central loop section 130*c*. The agitator 130 will in some cases help to prevent ice pieces at the center of hopper from clumping together or bridging, however, in most cases the agitator is not necessary. To carry away the ice from the outlet 26 is an ice outlet pipe 134 through which the ice falls by gravity. To help ice enter the outlet pipe 134 the bottom portion of the outlet 26 is inclined outwardly and downwardly as shown at 36 (FIGS. 2 and 9). An outlet duct 134 can be suitably secured to the outer wall of the hopper 22 in any convenient way as for example as by means of screws (not shown).

From this description it can be seen that the conveyor 24 will be much less subject to overloading and stalling than a conveyor or agitator driven from the center of the hopper because power is supplied by the pinion gear 114 precisely where it is needed, namely, at the periphery of the hopper 22. Moreover, the substantial gear reduction provided by the difference in size between the pinion gear and ring gear will furnish high torque thereby further reducing the chance of the motor M to stall or be damaged. In addition, the paddle blades 118 serve as peripheral agitators while moving around the hopper thereby helping to prevent ice pieces from freezing to the wall of the hopper 22. This again helps to eliminate a condition which could lead to overloading of the motor, stalling or damage of parts.

The invention thus provides a reliable and rugged ice maker in which the need for repair is held to a minimum largely through the use of the novel conveyor loacted entirely on the periphery of the hopper and driven from a point adjacent from the side wall of the hopper. Because the water which forms in the ice is reliably drained off, at 108, ice will slide better through outlet pipe 134 since wet ice has a tendency to stick to inside wall of an outlet pipe or hose.

In addition, the flow of expanding refrigerant gas will be distributed uniformly around the entire circumference of the ice forming chamber while at the same time contacting virtually the entire surface of tube 30 except along the lines where the inwardly projecting arcs 42 make contact. The jacket 32 can moreover be formed from the single tubular piece of sheet metal.

The apparatus can be formed from a variety of materials but plastic resin is preferred for certain parts such as the walls of the hopper and conveyor 24. 24. Plastic is desirable both because of its lower thermal conductivity and because of the reduced tendency of the ice in the hopper to stick to it. After the conveyor has been installed in the hopper it can be secured in place by means of plastic hold downs 160 and 162 that are fastened to the wall of the hopper by screws or other suitable fasteners.

Figure 11:
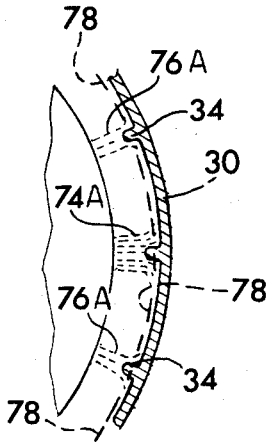
FIG. 11 is a partial diagramatic top view illustrating the manner in which the water jets strike the inner wall of the ice forming chamber.
Figure 3:
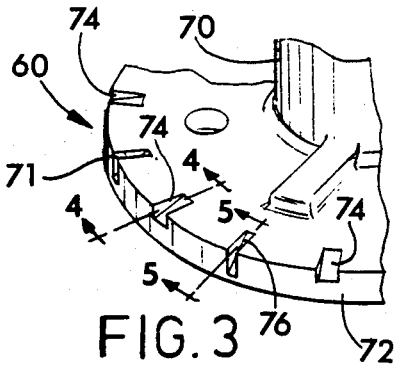
FIG. 3 is a partial perspective view on an enlarged scale of the water dispensing ring.
Figure 4:
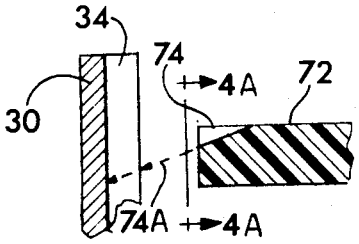
FIG. 4 is a enlarged cross-sectional view of the water dispensing ring taken on Line 4—4 of FIG. 3.
Figure 4A:
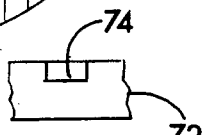
FIG. 4A is a side view taken on Line 4A—4A of FIG. 4.

It can also be seen in FIG. 11 that the water streams 74A and 76A will strike the ribs 34 and will thereby be diverted in opposite directions throughout the wall of the freezing chamber. This is accomplished by providing the same number of water jet outlets as there are ribs 34 and by placing them in alignment with each other. This provision appears to further assist in achieving a uniform distribution of water throughout the inside surface of the freezing chamber and this in turn helps to make the ice sheet 78 more uniform in thickness.

Many variations can be made in the invention. For example, the conveyor 24 may have fewer paddles and for some applications even one paddle may be enough. The shield 122 can be longer than shown but should be at least wide enough to cover the opening 26.

Many other variations of the invention within the scope of the appended claims will be apparent to those skilled in the art once the principles described above are understood.

What is claimed is:

1. A machine for making ice comprising a tubular ice forming chamber, refrigeration means associated with the chamber to chill the chamber to freezing temperature, a stripper mounted within the chamber for reciprocation along the axis of said chamber to strip the ice formed on the inner surface thereof and move it toward one end of said chamber, a breaker at the end of the chamber toward which the ice is moved by the stripper, said breaker being adapted to engage the ice and break it into pieces as the ice is moved by the stripper, a hopper having a side wall at the end of the chamber adjacent to the breaker to receive pieces of broken ice as they are forced past the breaker by the stripper and a hollow annular conveyor having an open center located in the middle of the hopper and being mounted within the hopper where said pieces of ice accumulate, said conveyor including at least one vertically disposed paddle connected thereto and adapted to move in a circle through the hopper as the annular conveyor is rotated about a central axis within the hopper to convey the ice pieces in a circle within the hopper, said hopper having an outlet port therein in lateral alignment with the paddle for the removal of the ice from the hopper and a drive means connected to the conveyor in proximity to the side wall of the hopper for imparting rotation to the annular conveyor to transport the cracked ice pieces within the hopper toward said outlet port and thereby dispense the ice from the hopper.

2. An ice forming machine having a freezing chamber for producing ice, transport means for forcing the ice from the freezing chamber toward an end thereof, a hopper to receive the ice forced out through the end of the chamber, said hopper having an outlet opening in one side thereof, a shield within the hopper at least partially covering the outlet and being spaced away from the outlet to provide a channel between the shield and wall of the hopper in which the outlet is situated and a conveyor means within the hopper, said conveyor comprising a hollow annular substantially circular conveyor body adapted to rotate upon its own axis within the hopper and including at least one paddle having a surface extending radially thereof adapted to pass through the channel between the shield and the outlet opening to convey ice in the channel to the outlet opening.

3. An ice machine having an ice forming chamber, a transport means for stripping the ice from the chamber and moving the ice through the chamber toward an end thereof, a hopper mounted at the top end of the chamber toward which the ice is moved by the stripper, a water reservoir at the top end of the chamber, said water reservoir having a cylindrical side wall with a circular bottom edge, spaced apart top and bottom walls, the bottom wall having a peripheral portion sealed against the bottom edge of the side wall and the periphery of the bottom wall having upwardly opening diagonally disposed radially extending notches therein to define a plurality of spaced-apart water jet openings positioned in spaced relationship from the inner wall of the chamber and oriented with respect to said inner wall of the chamber to spray water from the reservoir onto said inner wall and some of the jet openings being oriented in different directions with respect to the inner wall of the chamber to spray water from the reservoir different distances from said one end of the ice freezing chamber to provide more uniform distribution of water throughout the inner surface of the chamber and ice of more uniform thickness on the wall thereof.

4. The apparatus according to claim 3 wherein the ice forming chamber is oriented with its central axis extending vertically, the jet openings are circularly arranged and are spaced apart circumferentially with each being spaced inwardly from the inner wall of the freezing chamber and some of the jet openings are positioned to expel a jet of water that strikes the inner surface of the freezing chamber at a higher elevation than others of the jet openings.

5. An ice forming machine comprising a freezing chamber for producing ice, a water disperser for distributing a stream of water within the ice forming chamber to produce ice within the chamber, an ice transfer means for removing the ice from the chamber, a hopper to receive the ice transferred out of the ice forming chamber, said hopper being generally bowl shaped and having an outlet opening on one side thereof with a shield spaced inwardly therefrom to define a passage between itself and the hopper, said passage having an established height, width and length and an endless conveyor adjacent to the sidewall of the hopper including at least one ice advancing paddle adapted to travel through the passage and to transfer ice within the hopper into the passage and through the outlet opening.

6. In an ice forming machine having a freezing chamber for producing ice, a water disperser for distributing a stream of water within the ice forming chamber to produce ice within the chamber, an ice transfer means for removing the ice from the chamber and a hopper to receive the ice transferred out of the ice forming chamber, the improvement comprising a ring shaped conveyor having an open center positioned within the hopper for rotation therein about a center axis of the ring shaped conveyor positioned in alignment with the open center thereof, said ring shaped conveyor having at least one paddle thereon for agitating the ice within the hopper and said conveyor including circumferentially extending drive means extending entirely around the conveyor and a rotatable drive member operatively connected to the circumferentially extending drive means to impart rotation to the ring conveyor whereby ice is free to travel from the ice forming chamber axially of the ice forming machine through the center of the conveyor and to remain in storage within the center of the conveyor and said hopper having an outlet opening adjacent to the conveyor whereby the rotation of the conveyor will transfer ice from the center storage area radially through the outlet.

* * * * *